US007317428B2

(12) United States Patent
Bolle et al.

(10) Patent No.: US 7,317,428 B2
(45) Date of Patent: Jan. 8, 2008

(54) FORMING AN ANTENNA BEAM USING AN ARRAY OF ANTENNAS TO PROVIDE A WIRELESS COMMUNICATION

(75) Inventors: Cristian A. Bolle, Bridgewater, NJ (US); Carsten Metz, Township of chatham, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 97 days.

(21) Appl. No.: 11/329,374

(22) Filed: Jan. 10, 2006

(65) Prior Publication Data

US 2007/0159407 A1 Jul. 12, 2007

(51) Int. Cl.
*H01Q 21/00* (2006.01)

(52) U.S. Cl. ..... 343/853; 342/368; 342/372

(58) Field of Classification Search ..... 342/368, 342/369, 372; 343/853
See application file for complete search history.

(56) References Cited

U.S. PATENT DOCUMENTS

| | | | | |
|---|---|---|---|---|
| 3,166,748 | A * | 1/1965 | Shanks et al. | 342/351 |
| 6,195,045 | B1 * | 2/2001 | Xu et al. | 342/368 |
| 6,295,026 | B1 * | 9/2001 | Chen et al. | 342/368 |
| 6,335,703 | B1 | 1/2002 | Chang et al. | 343/700 |
| 2002/0171583 | A1 * | 11/2002 | Purdy et al. | 342/368 |
| 2004/0061644 | A1 * | 4/2004 | Lier et al. | 342/368 |

OTHER PUBLICATIONS

"Adaptive Arrays and Diversity Antenna Configurations for Handheld Wireless Communication Terminals," by Carl B. Dietrich, Jr. 2000.

"Optimizing Satellite Communications with Adaptive and Phased Array Antennas," by Mary Ann Ingram, et al, no date provided!

* cited by examiner

*Primary Examiner*—Tho Phan

(57) ABSTRACT

The present invention provides a method and an apparatus for forming an antenna beam from an array antenna having a rear facing side, an aperture, and including a first and a second radiating element. The method comprises injecting a synchronization signal wirelessly from a common source at the rear facing side of the array antenna to provide an initial calibration of the array antenna that synchronizes phase of an output signal from the first and second radiating elements to the common source. The method further comprises compensating a change in phase of the synchronization signal at the first radiating element based on a spatial displacement to synchronize phase of a first portion of the output signal from the first radiating element to the phase of the synchronization signal at the second radiating element in response to the spatial displacement of the first radiating element after the initial calibration of the antenna array. A synchronization source may couple to the phased array antenna wirelessly, such as optically or using radio frequency based coupling. To synchronize a portion of an output signal from a plurality of radiating elements, a phase shift unit and/or a time delay unit at each radiating element may lock its phase to a synchronization signal from a common or a point source regardless of a location thereof relative to the synchronization source. In this way, a synchronization source may synchronize the phase of the phased array antenna even if one or more radiating elements may move from an original spatial location to any arbitrary position.

20 Claims, 12 Drawing Sheets

(4)~$\hat{A} \cdot e^{j(\omega Lut - \frac{2\pi}{\lambda} \cdot D)}$ (5)~$\hat{A} \cdot e^{j(\omega Lut - \frac{2\pi}{\lambda} \cdot (D - L\eta))}$ (6)~$\hat{A} \cdot e^{-j\frac{2\pi}{\lambda} \cdot L\eta}$ (7)~$\hat{A} \cdot e^{j\omega Lut}$ (8)~$LC \cdot \hat{A} \cdot e^{-\frac{2\pi}{\lambda} \cdot D}$

FORMING AN ANTENNA BEAM USING AN ARRAY OF ANTENNAS TO PROVIDE A WIRELESS COMMUNICATION

BACKGROUND OF THE INVENTION

1. Field of the Invention

This invention relates generally to telecommunications, and more particularly, to wireless communications.

2. Description of the Related Art

In a telecommunication system, network planning and an optimal installation and deployment of network infrastructure components is important in order to increase system capacity and maximize network coverage. For example, a plurality of communication nodes, such as base stations with antennas may be geographically distributed across a coverage area. While locations of these communication nodes may be difficult to change, antennas provide mechanisms with which the antenna may be adapted to the various needs of a wireless network. Therefore, antennas play a crucial role in telecommunication systems, such as in digital cellular networks.

However, antennas, among other things, may suffer from different types of mechanical and/or electrical deformations. For example, a cellular antenna may undergo a variety of antenna deformations including warping, modifying the antenna's radiation pattern. An antenna deformation may distort an antenna beam and/or one or more associated lobes in the radiation pattern of a cellular antenna. Some antenna deformations also affect the radiation pattern from a source causing multi-paths and co-channel interference. A cellular antenna may include an array of antenna elements in that a deformed antenna array may alter a phase of an antenna signal and thus antenna lobes (e.g., main, rear and side), resulting in an undesired beam pattern. Accordingly, the cellular antenna may continuously rely upon optimization of coverage area and interference reduction.

To provide desired network coverage, multiple cell sites along with a large number of cells may be deployed. However, as the network capacity and number of cells increase, network throughput and capacity suffers due to cellular antenna deformations. Moreover, as the number of cells increase, antenna deformations may become prime sources of cell-to-cell interference. That is, an antenna deformation may result in a significant degradation in a vital network performance metric in digital cellular systems.

Increasingly light weight antennas are desired for wireless communications. However, this constraint results in a significantly less reinforced or weaker structure for an array antenna of radiating or radar elements. When using such a weaker reinforcement structure, the shape or flatness of the antenna array may be difficult to control. Moreover, as the number of antenna elements increase to provide a narrow antenna beam, the number of errors of phase, which may affect the main lobe of the antenna beam, also increase. In other words, an array environment comprising a large number of antenna elements may fail to focus the main lobe of the antenna beam because the location of each antenna element relative to a deformed aperture of the antenna array.

Referring to FIG. 2, a deformed phased array antenna 200 is illustrated to include an array of antenna elements 205(1-121) distributed over a desired aperture 210. Each antenna element of the array of antenna elements 205(1-121) may receive the same information, i.e., a signal that coherently drives each individual element 205. In this way, all the antenna elements 205(1-121) may radiate in phase. However, as shown in FIG. 2, the desired aperture 210 may deform into a deformed aperture 210*a*, causing the antenna elements 205(1-121) to alter phase. The deformed aperture 210*a* provides an output signal from each antenna element that results in interference, causing the deformed phased array antenna 200 to form an antenna beam having a misshaped main lobe. That is, absent a flat surface of the antenna array of the antenna elements 205(1-121), the phased array antenna 100 in a deformed state may provide transmit or receive signals in space causing individual waves to interfere in an undesired way.

However, any undesired shift in the antenna beam may provide a radiation pattern that requires constant adjustment. In particular, for the deformed phased array antenna 200, interference conditions may change even if all the antenna elements 205(1-121) may be connected via a fixed network of transmission lines. For example, the aperture 210 may change to the deformed aperture 210*a* if the antenna array of the antenna elements 205(1-121) warps because of temperature or other environmental condition(s), which may cause one or more antenna elements 205 to mechanically shift from their original position.

Referring to FIG. 3, a directional radiation pattern 300 is illustrated for the deformed phased array antenna 200 shown in FIG. 2. In the phased array antenna 200, a set of antenna elements 205 located near the center of the antenna array may form the aperture 210*a*, while the remaining antenna elements 205 may provide the aperture 210. In this way, the curvature of the deformed phased array antenna 200 may cause one or more changes in at least one interference condition. This change in the interference condition may cause the deformed phased array antenna 200 to form a plurality of antenna beams instead of one main lobe. The plurality of side lobes may defocus the antenna beam.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present invention is directed to overcoming, or at least reducing, the effects of, one or more of the problems set forth above.

In one embodiment of the present invention, a method is provided for forming an antenna beam from an array antenna having a rear facing side, an aperture, and including a first and a second radiating element. The method comprises injecting a synchronization signal wirelessly from a common source at the rear facing side of the array antenna to provide an initial calibration of the array antenna that synchronizes phase of an output signal from the first and second radiating elements to the common source. The method further comprises compensating a change in phase of the synchronization signal at the first radiating element based on a spatial displacement to synchronize phase of a first portion of the output signal from the first radiating element to the phase of the synchronization signal at the second radiating element in response to the spatial displacement of the first radiating element after the initial calibration of the antenna array.

BRIEF DESCRIPTION OF THE DRAWINGS

The invention may be understood by reference to the following description taken in conjunction with the accompanying drawings, in which like reference numerals identify like elements, and in which.

Figure 1:
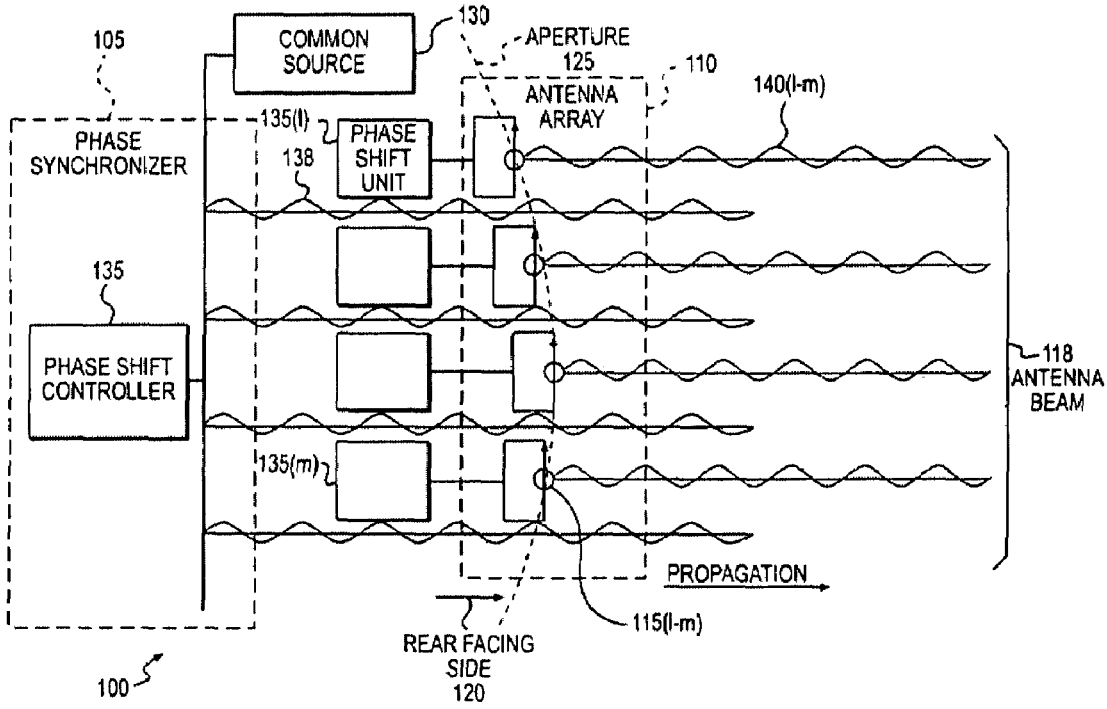
FIG. 1 schematically illustrates a phased array antenna that includes a phase synchronizer to synchronize output and/or input to or from an array of radiating elements in accordance with one embodiment of the present invention.
Figure 2:
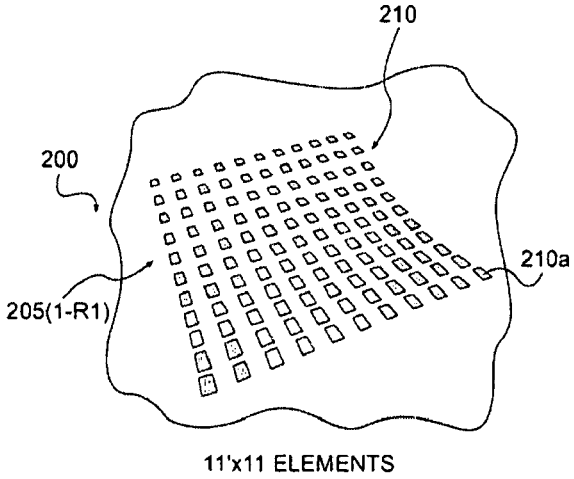
FIG. 2 (PRIOR ART)
FIG. 2 illustrates a deformed phased array antenna.
Figure 3:
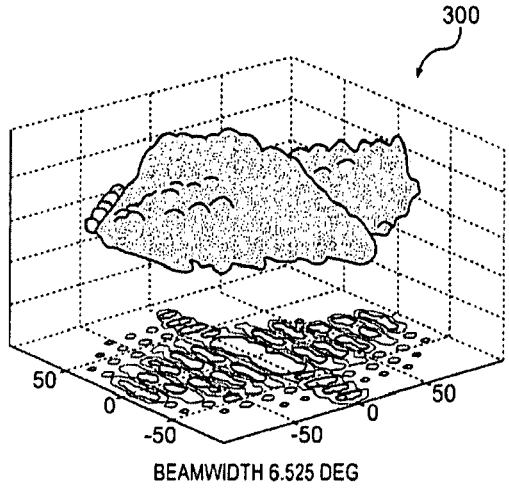
FIG. 3 (PRIOR ART)
FIG. 3 illustrates a directional radiation pattern for the deformed phased array antenna shown in FIG. 2.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions may be made to achieve the developers' specific goals, such as compliance with system-related and business-related constraints, which will vary from one implementation to another. Moreover, it should be appreciated that such a development effort might be complex and time-consuming, but may nevertheless be a routine undertaking for those of ordinary skill in the art having the benefit of this disclosure.

Generally, a method and an apparatus are provided for forming an antenna beam from an array antenna having a rear facing side, an aperture, and including a first and a second radiating element. The method comprises injecting a synchronization signal wirelessly from a common source at the rear facing side of the array antenna to provide an initial calibration of the array antenna that synchronizes phase of an output signal from the first and second radiating elements to the common source. The method further comprises compensating a change in phase of the synchronization signal at the first radiating element based on a spatial displacement to synchronize phase of a first portion of the output signal from the first radiating element to the phase of the synchronization signal at the second radiating element in response to the spatial displacement of the first radiating element after the initial calibration of the antenna array. A substantially plane wave signal from a common source may radiate the rear facing side of the array antenna. In response to the plane wave signal, each of the first and second radiating elements of the array antenna may lock phase of a corresponding portion of an output signal from the array antenna to the common source. A synchronization source may couple to the phased array antenna wirelessly, such as optically or using radio frequency based coupling. To synchronize a portion of an output signal from a plurality of radiating elements, a phase shift unit and/or a time delay unit at each radiating element may lock its phase to a synchronization signal from a common or a point source regardless of a location thereof relative to the synchronization source. In this way, a synchronization source may synchronize the phase of the phased array antenna even if one or more radiating elements may move from an original spatial location to any arbitrary position.

Referring to FIG. 1, a phased array antenna 100 is illustrated to include a phase synchronizer 105 to synchronize phase of signals received or transmitted to or from the phased array antenna 100 according to one embodiment of the present invention. The phased array antenna 100 may further comprise an antenna array 110 including a plurality of radiating elements 115(1-m). Each radiating element 115 of the phased array antenna 100 may receive a synchronization signal 138 from the phase synchronizer 105 to form an antenna beam 118 from the plurality of radiating elements 115(1-m). To obtain a desired radiation pattern from the phased array antenna 100, the phase synchronizer 105 may synchronize the phase of signals received or transmitted to or from each radiating element 115 of the plurality of radiating elements 115(1-m) regardless of a location thereof relative to a source of the synchronization signal 138.

By synchronizing the phase for the plurality of radiating elements 115(1-m) based on the synchronization signal 138, the phase synchronizer 105 may form the antenna beam 118 from the phased array antenna 100. For example, the phased array antenna 100 may comprise a first and a second radiating element 115(1-2) that may be spatially arranged and electrically connected to form the antenna beam 118 having a directional radiation pattern. The phase synchronizer 105 may inject a substantially plane wave, i.e., the synchronization signal 138 at the first and second radiating elements 115(1-2) from a rear facing side 120 of the phased array antenna 100.

In one embodiment, the phase synchronizer 105 may comprise a common source 130 to drive the phased array antenna 100. The common source 130 may couple wirelessly the synchronization signal 138 to each radiating element 115 of the phased array antenna 100. The phase synchronizer 105 may further comprise a phase shift controller 135 to control the phase of each radiating element 115 at an aperture 125 of the array antenna 110 regardless of a spatial location thereof within the phased array antenna 100.

To synchronize the phase, each radiating element 115 of the phased array antenna 100 may lock its phase of the synchronization signal 138. Each radiating element 115 may comprise a phase shift unit 135(x, x=1-m) to radiate at the same phase. That is, the phase shift units 135(1-m) may shit the phase of a non-ideal synchronization signal, such as that of the synchronization signal 138 at the plurality of radiating elements 115(1-m) so that all the signals received or transmitted from the array antenna 110 may be in phase in a propagation direction at an aperture 125. The term phase may be referred to the phase of the synchronization signal 138 at the aperture 125 of the array antenna 110 relative to a plane on which the common source 130 may be disposed.

By injecting the synchronization signal 138 wirelessly from the common source 130 at the rear facing side 120 of the array antenna 110, the phase synchronizer 105 may provide an initial calibration of the array antenna 110 that synchronizes phase of an output signal 140 from the first and second radiating elements to the common source 130. The phase shift unit 135(1) may compensate a change in phase of the synchronization signal 138 at the first radiating element 115(1) based on a spatial displacement relative to the common source 130 to synchronize phase of a first portion of the output signal 140(1) from the first radiating element 115(1) to the phase of the synchronization signal 138 at the second radiating element 115(2) in response to the spatial displacement of the first radiating element 115(1) after the initial calibration of the antenna array 110.

The common source 130 may provide the synchronization signal 138 that may substantially be a plane wave incident on the aperture 125 of the array antenna 110. Each phase shift unit 135(x, x=1-m) may time a same phase to reach at each radiating element 115 to form a phased array in a synchronized phase relationship at the plurality of radiating elements 115(1-m). The phase shift units 135(1-m) may remove a frequency offset at the plurality of radiating elements 115(1-m). In other words, each phase shift unit 135(x, x=1-m) may sample the synchronization signal 138 to cause each of the radiating elements 115(1-m) to activate at a desired instant of time for operating at a same frequency.

Consistent with one embodiment, the common source 130 may couple to the phased array antenna 100 wirelessly. Examples of such wireless coupling includes radio frequency (RF) coupling and optical coupling. To form the antenna beam 118, in one embodiment each radiating element 115 may amplify the synchronization signal 138 and lock to the phase to the common source 130.

In operation, the common source 130 may provide the synchronization signal 138 that may controllably illuminate or trigger the first and second radiating elements 115(1-2) from the rear facing side 120 of the phased array antenna 100. In response to the synchronization signal 138, the phase shift units 135(x, x=1-m) of the first and second radiating elements 115(1-2) may provide an output signal 140 having the phase synchronized to the common source 130. Each of the output signals 140(1-m) of the plurality of radiating elements 115(1-m) may have the same phase on the aperture 125 of the array antenna 110. In this way, the phase shift units 135(1-m) may provide a flat curvature for the synchronization signal 138 from the common source 130 at the plurality of radiating elements 115(1-m) regardless of a spatial location.

Figure 4:
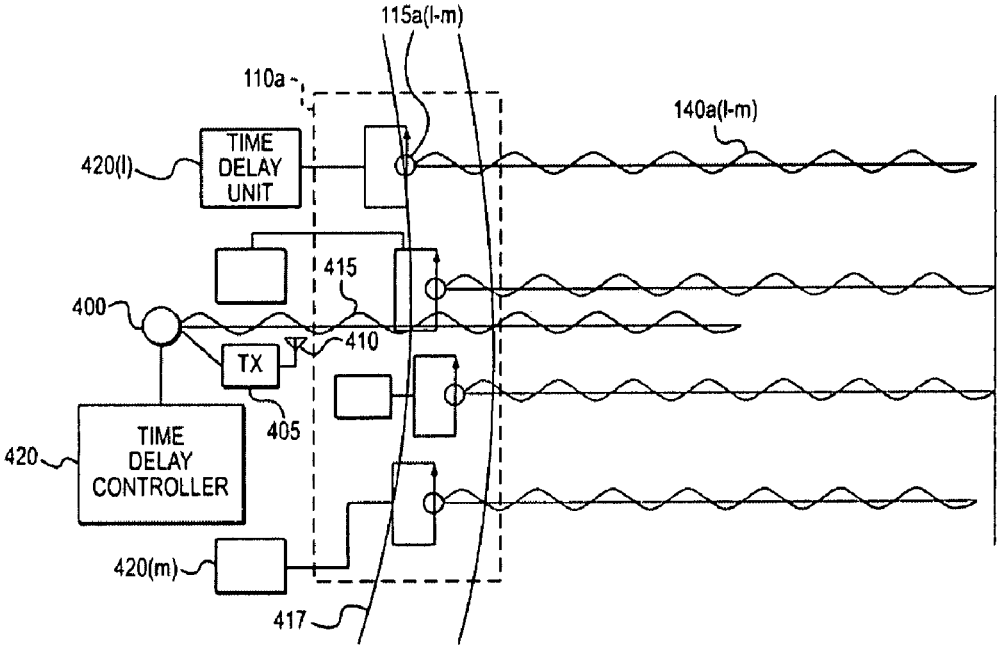
FIG. 4 schematically depicts the phased array antenna driven by a point source in accordance with one embodiment of the present invention.

Referring to FIG. 4, a point source 400 is schematically depicted to drive the phased array antenna 100 in accordance with one embodiment of the present invention. For providing a plane wave based synchronization to an array antenna 110*a*, the point source 400 may comprise a transmitter (TX) 405 having an antenna 410 to provide a wave front 415 having a sufficiently flat a curvature of phase 417. The array antenna 100*a* may comprise a plurality of radiating elements 115*a*(1-m). The point source 400 may further comprise a time delay controller 420 to synchronize the phase of the phased array antenna 100*a* even if one or more radiating elements 115*a* may move from an original spatial location to any arbitrary position.

To synchronize a plurality of output signals 140*a*(1-m) from the plurality of radiating elements 115*a*(1-m), a time delay unit 420(x, x=1-m) at each radiating element 115*a* may lock its phase to the point source 400. To this end, the time delay units 420(1-m) may selectively delay the phase of the synchronization signal 138 at the radiating elements 115*a*(1-m) to flatten the curvature of phase 417 of a phase or the wave front 415. By flattening the curvature of phase 417 of the wave front 415 associated with the synchronization signal 138 the time delay units 420(x, x=1-m) at the radiating elements 115*a* may compensate the curvature of phase 417 of the wave front 415 at the array antenna 100*a* based on a time delay. In other words, the time delay units 420(x, x=1-m) may apply the time delay to a radiating element 115*a* such that an amplified plane wave signal may lock its phase to the point source 400.

To cause each of the amplified synchronization signal, which may be phase locked to the point source 400 to be in phase with others, the phase of the synchronization signal 138, the time delay units 420(x, x=1-m) may calibrate off the curvature of phase 417 in the wave front 415. For calibrating off the curvature of the phase 417, the time delay units 420(x, x=1-m) may subtract a time delay at the center of the array antenna 100*a*, delaying the phase the phase of one set of the radiating elements 115*a* located proximal to the center of the array antenna 110*a* relative to another set of the radiating elements 115*a* located at the distal ends of the array antenna 110*a*.

In this way, the time delay units 420(x, x=1-m) may flatten a spherical nature of the curvature of phase 417 for the wave front 415 even when the radiating elements 115*a* (1-m) may move back and forth or have a spatial movement in one or more dimensions. As a result, the array antenna 110*a* may generate a coherent antenna beam with all the output signals 140*a* in phase. By flattening the curvature of phase 417 for the wave front 415 based on a synchronization signal, the time delay units 420(x, x=1-m) may compensate a phase difference between at least two radiating elements 115*a*(1-2). To this end, a delay may be programmed into each antenna element 115*a* to compensate a cylindrical curvature of the wave front 415.

Figure 5:
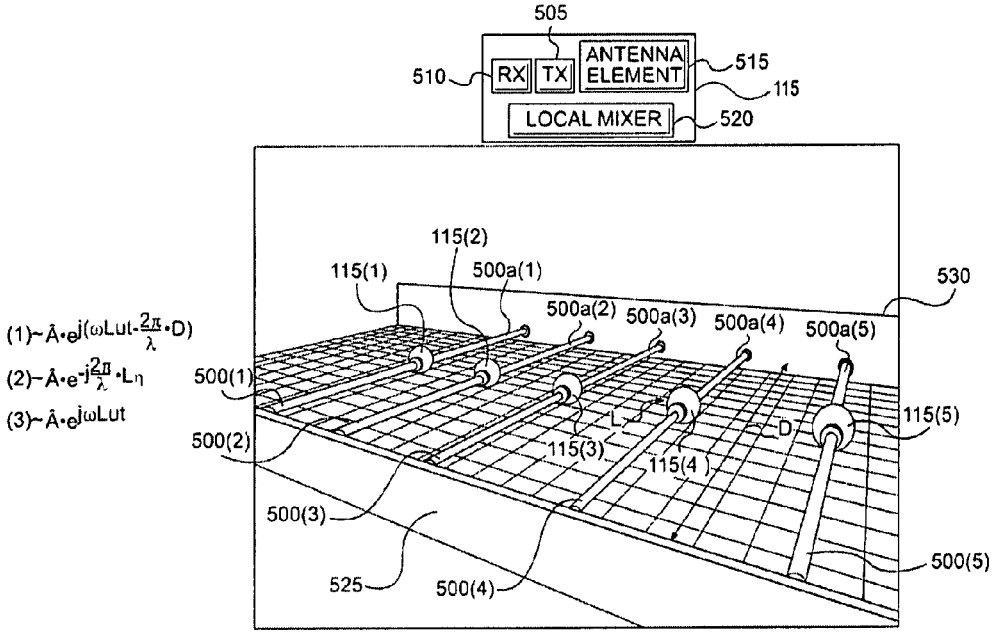
FIG. 5 illustrates synchronization of a plurality of transmit signals in the case of one dimensional (ID) movement of the array of radiating elements for the phased antenna array shown in FIG. 1 consistent with one embodiment of the present invention.

Referring to FIG. 5, synchronization of a plurality of transmit signals 500(1-5) is illustrated in the case of a 1D movement of the radiating elements 115(1-5) of the phased array antenna 100 shown in FIG. 1 consistent with one embodiment of present invention. Each radiating element 15 may comprise a transmit (TX) circuit 505, a receive (RX) circuit 510, an antenna element 515 and a mixer 520. For brevity, components of only one radiating element 115 are shown in FIG. 5. However, persons of an ordinary skill in the pertinent art would recognize that or same similar components may be deployed at other radiating elements in the phased antenna array 100.

Arrows 500*a*(1-5) may indicate a plane wave that may propagate along a propagation direction from a source such as the common source 130 shown in FIG. 1. A first plane 525 indicates a point of injection to the radiating elements 115(1-5). Likewise, a second plane 530 indicates transmission of the transmit signals 500*a*(1-5) emitted from the radiating elements 115(1-5). The radiating elements 115(1-5) may move back and forth in one dimension along the arrows 500*a*(1-5). However, regardless of the spatial location or position of a particular radiating element 115 relative to the first plane 525 on which the point of injection lies, the phase may be set for a transmit signal 500 such that the phase of all the transmit signals 500(1-5) may be the same. For example, equations (1-3) indicate synchronization of the phase of the transmit signals 500(1-5).

$$\hat{A}\cdot e^{j(\omega_{Do}t-\frac{2\pi}{\lambda}\cdot D)} \tag{1}$$

$$\hat{A}\cdot e^{-j\frac{2\pi}{\lambda}\cdot l_n} \tag{2}$$

$$\hat{A}\cdot e^{j\omega_{Do}t} \tag{3}$$

In equation (1), the term "D" indicates the distance between the first plane 525 and the second plane 530. Likewise, the term "ln" represents a distance for each radiating element 115 from the first plane 525, i.e., on which the point of injection lies, such as the common source 130 shown in FIG. 1 may be located.

Figure 6:
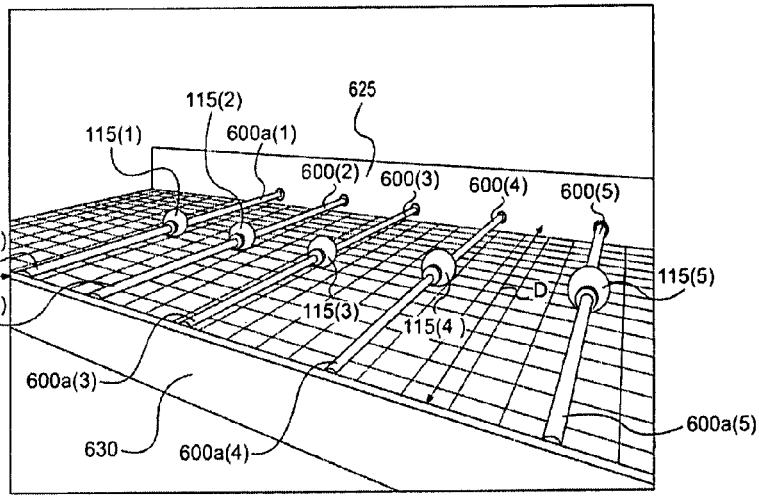
FIG. 6 illustrates synchronization of a plurality of received signals in the case of one dimensional (ID) movement of the array of radiating elements for the phased array antenna shown in FIG. 1 consistent with another embodiment of the present invention.

Referring to FIG. 6, synchronization of a plurality of receive signals 600(1-5) is illustrated in the case where the radiating elements 115(1-5) may move or change location in one dimension (1D) indicated by arrows 600*a*(1-5) according to one embodiment of the present invention. The receive signals 600(1-5) may arrive at a first receive plane 625 at a phase indicated by the equation (4).

$$\hat{A}\cdot e^{j(\omega_{Do}t-\frac{2\pi}{\lambda}\cdot D)} \tag{4}$$

The received signals 600(1-5) may travel toward the radiating elements 115(1-5) of the phased antenna array 100. As shown in equation (5), the phase of the received signals 600(1-5) may vary as indicated by the term $2\pi/x\cdot(D-ln)$ in equation (5).

$$\hat{A}\cdot e^{j(\omega_{Do}t-\frac{2\pi}{\lambda}\cdot(D-l_n))} \tag{5}$$

In other words, the radiating elements 115(1-5) may move back and forth in one dimension, as the arrows 600*a* (1-5) indicate. The received phase at the first received plane 625 may change with respect to the location of the radiating element 115.

At a synchronization plane wave 630, a local oscillator 640 may provide a local oscillator signal 645 to the radiating elements 115(1-5). That is, the synchronization source 640 may be disposed in order to emit an essentially flat synchronization plane wave 630 to inject the local oscillator signal 645 at a local mixer, i.e., the mixer 520 associated with each radiating element 115, as shown in FIG. 5. The local mixer 520 may mix a receive signal 600 and the local oscillator signal 640 from the local oscillator 645 to down-convert the phase of the received signals 600(1-5) for providing an output a signal that is independent of the location of the radiating element 115, as shown in equations (6) and (7).

$$\hat{A}\cdot e^{-j\frac{2\pi}{\lambda}\cdot l_n} \tag{6}$$

$$\hat{A}\cdot e^{j\omega_{Do}t} \tag{7}$$

Since two plane waves may travel in opposite directions and collide at the location of the radiating element 115, the local mixer 520 may compensate for a phase. The equation (6) represents the local oscillator signal 645 that each radiating element 115 may receive.

The local mixer 520 may mix or multiply a received phase of the received signal 600 with the local phase of the local oscillator signal 645 to provide a signal based on the distance "D" from which the receive phase is initiated. In other words, the received phase of the received signal 600 is not based on the spatial location of the radiating element 115 any more, as shown in equation (8).

$$L_C\cdot\hat{A}\cdot e^{-j\frac{2\pi}{\lambda}\cdot D} \tag{8}$$

By causing the received phase of each received signal 600 to be independent of the location of the radiating element 115, the phase of the received signals 600(1-5) becomes independent of deformation or movement of the radiating elements 115(1-5) in the phased array antenna 100.

Figure 7:
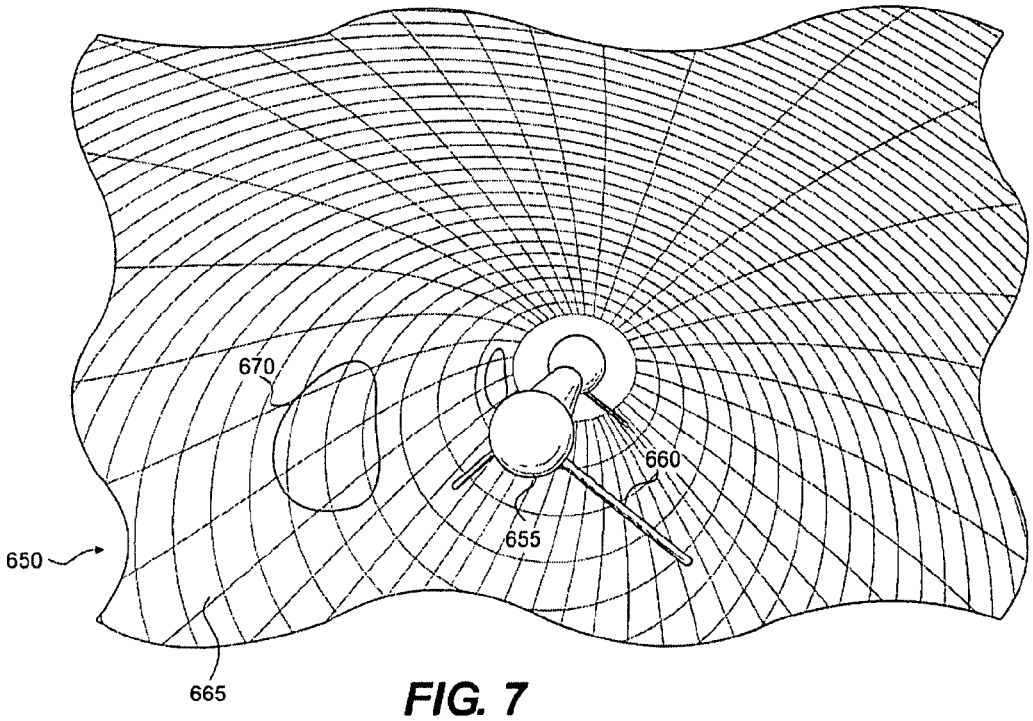
FIG. 7 illustrates an optics based phased array antenna in accordance with one embodiment of the present invention.

Referring to FIG. 7 an optics based phased array antenna 650 is illustrated in accordance with one embodiment of the present invention. In a free space optics based phased array antenna, e.g., the optics based phased array antenna 650, a central antenna 655 may inject the local oscillator signal 645 on an antenna aperture 665. A radio frequency (RF) carrier on a laser beam 660 may synchronize the phase of a transmit signal. A synchronization source may distribute a common timing signal on an optical carrier for this synchronization.

In operation, the central antenna 655 may inject a radio frequency wave, such as the synchronization signal 138 on the antenna aperture 665 that may have a curvature 670. To this end, an interrogation process may indicate a variation in the antenna aperture 665 at a particular location of the array antenna 650. A location measurement may enable synchronization of the phase of a signal on a tile-to-tile basis. For example, an optical unit may be located at the center of the array antenna 650, as shown in FIG. 7. Alternatively, the optical unit may provide the laser beam 660, which may be disposed behind the array antenna 650.

In another embodiment, a radio frequency (RF) unit may provide the synchronization for a radio frequency (RF) antenna. A synchronization source may inject the phased array antenna 100 with the wirelessly coupled the synchronization signal 138.

According to one embodiment of the present invention, each radiating element 115 may include an optical-to-electrical converter and vice versa. In this manner, wireless coupling of an optical or an electrical, such as a RF unit may provide the timing signal to each radiating element 115. A timing unit may generate a timing signal for injecting each radiating element 115 either using an optics-based wireless transfer or using a radio frequency (RF) wave propagation, for example, at a low frequency to compensate movements of the array of the radiating elements 115 in the phased antenna array 100.

Consistent with one embodiment, to provide a desired phase, the timing signal may trigger each antenna element 115 at a desired time such that the phase of an output signal from the radiating element 115 across all the radiating elements 115(1-5) stays same in the phased antenna array 100. Each radiating element 115 may emit a wave that is synchronized to other waves emitted by the adjoining radiating elements 115. In this way, each radiating element 115 may synchronize to a synchronization source.

Figure 8:
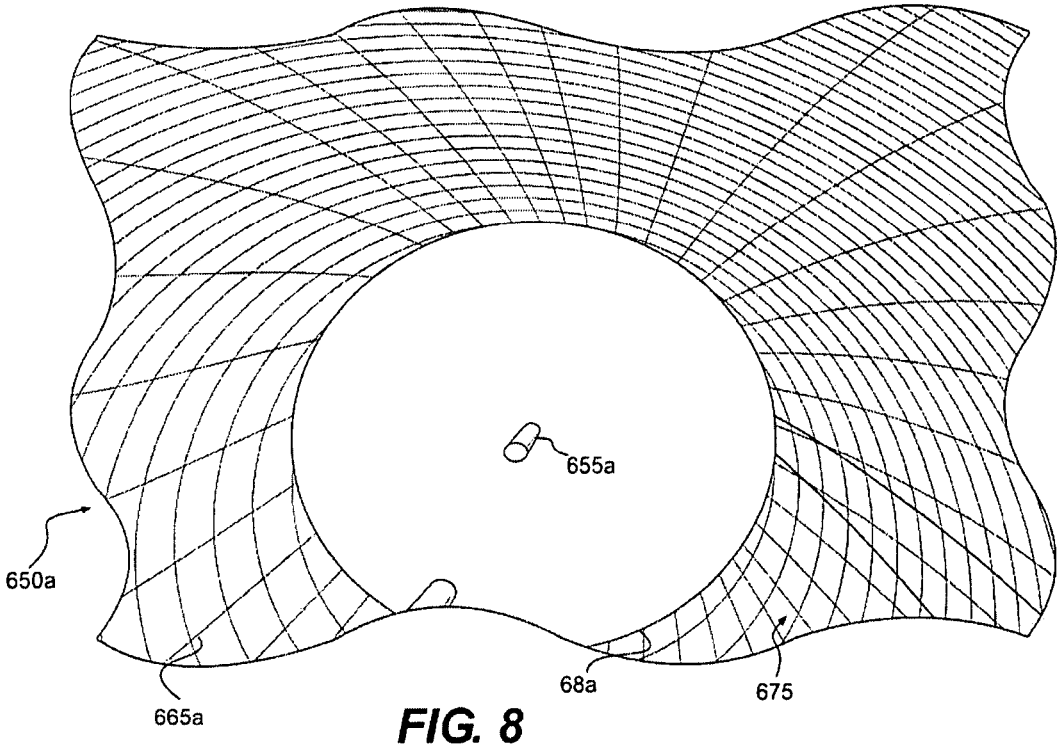
FIG. 8 illustrates a radio frequency based phased array antenna according to one embodiment of the present invention.

Referring to FIG. 8, a radio frequency (RF) based phased array antenna 650*a* includes a synchronization source 655*a* that provides a radio frequency antenna at the center of RF phased array antenna 650*a* according to one embodiment of the present invention. The RF based array antenna 650*a* may comprise an antenna array 665*a* that includes a plurality of antenna tiles 675. The synchronization source 665*a* may distribute a timing signal on a radio frequency (RF) carrier to the plurality of antenna tiles 665. A radiation pattern 680 for the synchronization source 665*a* may radiate the plurality of antenna tiles 665. By using a radio frequency (RF)-based synchronization, the phase of an antenna element disposed at each antenna tile may synchronize the phase of an output signal to the synchronization source 665*a*. A desirable synchronization frequency for the RF antenna at the synchronization source 655*a* may provide the timing signal for synchronization, as described above.

Figure 9:
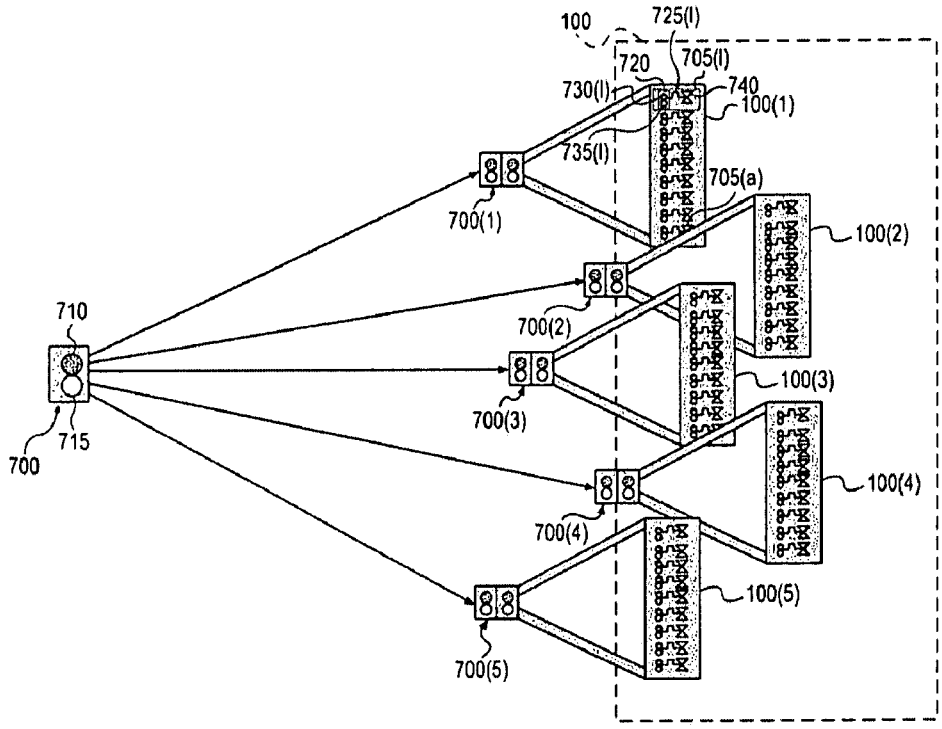
FIG. 9 illustrates a hierarchical calibrator for the phased array antenna shown in FIG. 1 in accordance with one embodiment of the present invention.

Referring to FIG. 9, a hierarchical calibrator 700 that provides a common calibration source for the phased array antenna 100 shown in FIG. 1 is illustrated in accordance with one embodiment of the present invention. The phased antenna array 100 may comprise a plurality of antenna arrays 100(1-5). Each antenna array 100(1-5) may include a plurality of antenna elements 705(1-9). The hierarchical calibrator 700 may calibrate the plurality of antenna arrays 100(1-5) while an individual calibration source may couple to each antenna array, such as the antenna array 100(1), the common calibration source from the hierarchical calibrator 700 may couple the individual calibration sources 700(1-5) to form a hierarchical calibration beam. The hierarchical calibrator 700 may comprise a common transmitter (TX) 710 and a common receiver (RX) 715. The hierarchical calibrator 700 may wirelessly or optically couple to each individual calibration source 700(1-5).

The common transmitter 710 may comprise a point light source for synchronization and the common receiver 715 an optical detector 715 for combining one or more detected analog signals, while the antenna arrays 100(1-5) may each include a plurality of antenna elements 705(1-9), each antenna element 705, such as in the antenna array 705(1) may comprise a programmable delay line 725(1) coupled to a transmit-receive module 720. The transmit-receive module 720 may further comprise an individual detector 730(1) for triggering a beam. The transmit-receive module 720 may further comprise an individual analog beamed light source 735 for combining the detected signal. Each antenna element 705 of the antenna array 100(1) may further comprise an antenna 740 coupled to the delay line 725, which in turn, couples to the transmit-receive module 720.

The transmit-receive module 720 may interface with the individual calibration source 700(1) that may combine a signal detected by the transmit-receive module 720 associated with the antenna element 705(1). The hierarchical calibrator 700 may interrogate each antenna element, such as the antenna element 705(1) to determine a location of that antenna element within the antenna array 100(1). The hierarchical calibrator 700 may also determine the location of the antenna element 700(1) relative to the antenna array 100(2). By determining the location of each antenna element 705, the hierarchical calibrator 700 may control the individual calibration sources 700(1-5) to calibrate off a spherical curvature of the antenna aperture 125 for the phased antenna array 100. For example, a timing unit at a particular antenna element 705 may provide a timing signal to calibrate each antenna element 705 to a common calibration source for synchronizing the phase of an output signal therefrom.

Figure 10:
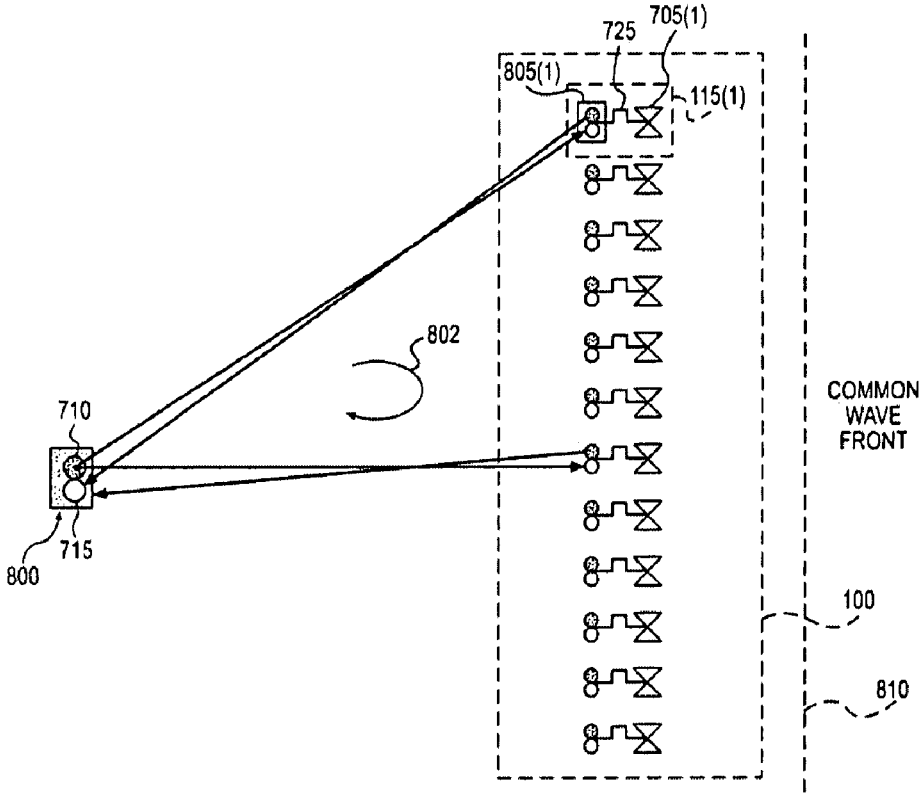
FIG. 10 illustrates phase front planarization for the phased antenna array shown in FIG. 1 in accordance with one embodiment of the present invention.

Referring to FIG. 10, phase front planarization for the phased array antenna 100 shown in FIG. 1 is illustrated in accordance with one embodiment of the present invention. A common calibration source 800 may adjust individual time delays associated with a particular radiating element 115 to match a pulse on a round trip 802. By matching the pulse, the common calibration source 800 may cause each detector 805 to appear on a common wave front 810. For example, three fixed distances between the common calibration source 800 and each corresponding radiating element 115 may recalibrate the time delay to cause the detector 805(1) to appear on the common wave front 810, which is substantially flat.

Figure 11:
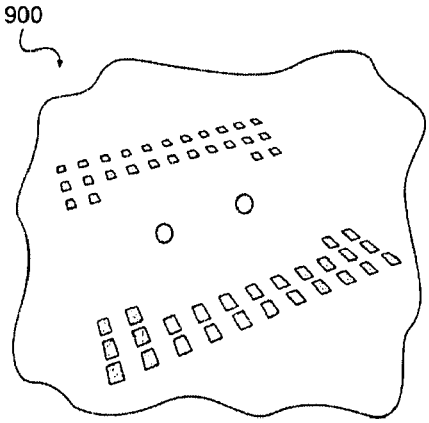
FIG. 11 schematically depicts an array of antenna radiating elements with a radiation source in accordance with one embodiment of the present invention.

Referring to FIG. 11, an array of antenna radiating elements 900 is schematically illustrated with a radiation source to provide a synchronized output in accordance with one embodiment of the present invention. For example, the radiation source may be located at 12 wave lengths below the array of antenna radiating elements 900. In one embodiment, the radiation source may be a wireless calibration source aligned normal to the array of antenna radiating elements 900.

Figure 12:
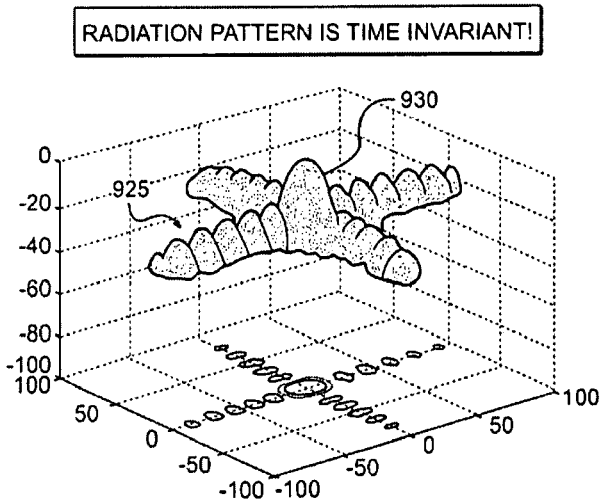
FIG. 12 schematically illustrates a radiation pattern for the array of antenna radiating elements shown in FIG. 11 according to one embodiment of the present invention.

Referring to FIG. 12, a radiation pattern 925 of the array of antenna radiating elements 900 is schematically illustrated according to one embodiment of the present invention. The radiating pattern 925 includes a main lobe 930 for the antenna beam 118, which is formed by the array of antenna radiating elements 900. The radiation pattern 925 may be time invariant such that the output signals 140 that from the array of antenna radiating elements 900 result in phase. In this way, without a dynamic calibration, the synchronized output, such as the antenna beam 118 may synchronize a radiation pattern, causing the array of antenna elements 900 to form a focused antenna beam.

Figure 13:
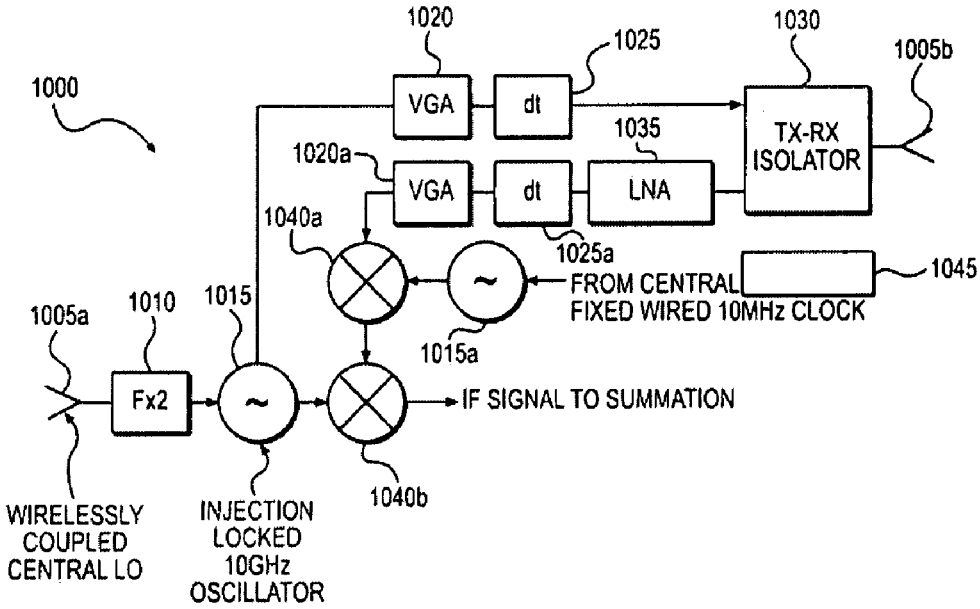
FIG. 13 schematically depicts a circuit that calibrates the array of radiating elements of the phased antenna array shown in FIG. 1 in frequency domain according to one embodiment of the present invention.

Referring to FIG. 13, a circuit 1000 for each radiating element 115 is schematically illustrated to calibrate the radiating elements 115(1-m) of the phased antenna array 100 shown in FIG. 1 according to one embodiment of the present invention. The circuit 1000 may comprise a first antenna 1005*a* and a second antenna 1005*b*. The first antenna 1005*a* may couple to the local oscillator 640 that provides the local oscillator signal 645. The first antenna 1005*a* may be coupled to a frequency doubler (f×2) 1010 to double the frequency that the first antenna 1005*a* may receive for the local oscillator signal 645 when coupled wirelessly to a central local oscillator (LO). The frequency doubler 1010 may inject a doubled local oscillator signal to a signal oscillator 1015.

To provide amplitude and phase control of the aperture 125 for the phased array antenna 100, the circuit 1000 may further include a voltage-controlled variable amplifier, such as a variable gain amplifier (VGA) 1020 coupled to a phase shifter 1025 (dt). The variable gain amplifier 1020 may provide amplitude control and the phase shifter 1025 may compensate the curvature of phase 417 for the synchronization source, such as the common source 130 shown in FIG. 1. In the transmit case, the variable gain amplifier 1020 and the phase shifter 1025 may provide a signal to a transmit receive (TX-RX) isolator 1030 that may further transmit a transmit signal over the second antenna 1005*b*.

In the receive case, the second antenna 1005*b* may receive a receive signal at the transmit-receive isolator 1030. The transmit-receive isolator 1030 may couple to a local amplifier 1035 to amplify the signal. The local amplifier 1035 is further coupled to a phase shifter (dt) 1025*a* and a variable gain amplifier (VGA) 1020*a* to control the amplitude and phase of the aperture for a received signal. That is, the phase shifter 1025*a* may shift the phase of the received signal to synchronize the phase with other receive signals that the phased array antenna 100 receives. This phase synchronization may synchronize the receive signals relative to the common source 130.

The variable gain amplifier 1020*a* may further send the received signal to a first mixer 1040*a*. The first mixer 1040*a* may receive a fixed clock to provide a desired intermediate frequency (IF) signal. For example, in one embodiment, an oscillator 1015*a* may provide a 10 MHz signal to the first mixer 1040*a*. A clock generator 1045 may provide a fixed clock, such as 10 MHz from a central clock generator. A second mixer 1040*b* may receive the signal from the first mixer 1040*a*. The second mixer 1040*b* may eliminate the spatial dependence of the antenna location from the received signal. That is, the second mixer 1040*b* receives or wirelessly couples to the synchronization source and mixes the received signal with a signal received from the synchronization source.

In this way, the spatial location of the second antenna 1005*b* of the phase array antenna 100 may receive signals in phase for each radiating element 115. The phased antenna array 100 may sum up the received signals from each second antenna 1005*b* of the phased array antenna 100 to provide a total antenna output in phase from the phased antenna array 100.

In one embodiment, the local oscillator 640 may provide the local oscillator signal 645 at 5 GHz to the oscillator 1015 for causing the circuit 1000 to operate at 10 GHz. Likewise, the oscillator 1015*a* may provide an intermediate frequency (IF) signal for summation at the second mixer 1040*b* based on an intermediate frequency (IF) clock 10 MHz. In this way, the oscillator 1015 may use an injection lock to operate at 10 GHz, while the oscillator 1015*a* may receive the fixed clock from the central clock generator 1045 at 10 MHz for the first mixer 1040*a*.

By controlling the phase of the received and transmit signals and/or calibrating off a synchronization signal 138, the circuit 1000 may provide the synchronization for the aperture 125 of the phased antenna array 100. Since the circuit 1000 may move back and forth along with the radiating element 115 and wirelessly couple to a central local oscillator, a synchronization source, such as the common source 130, may synchronize the phase of the transmit and/or receive signals.

Figure 14:
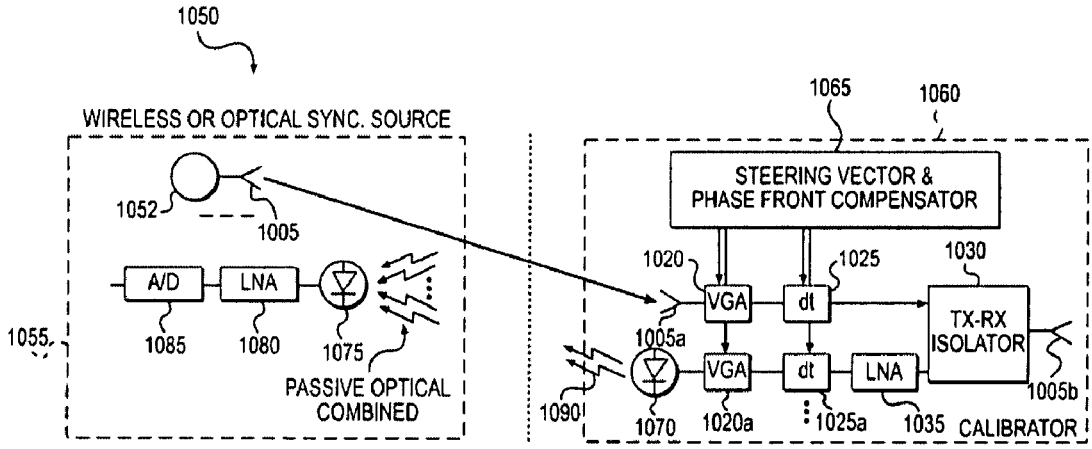
FIG. 14 schematically depicts a circuit that calibrates the array of radiating elements of the phased antenna array shown in FIG. 1 in time domain in accordance with one embodiment of the present invention.

Referring to FIG. 14, a circuit 1050 is schematically illustrated to calibrate off the plurality of radiating elements 15(1-m) for the phased array antenna 100 shown in FIG. 1 in the time domain according to one embodiment of the present invention. The circuit 1050 may comprise a synchronization source 1055 and a calibrator 1060 to provide calibration in the time domain. Examples of the synchronization source 1055 include a wireless or optical synchronization source. In one embodiment, the synchronization source 1055 may comprise a signal generator 1052 coupled to an antenna 1005 to wirelessly couple the synchronization source 1055 to the calibrator 1060.

To provide the calibration in the time domain, the calibrator 1060 at each radiating element 115 may comprise a compensator 1065 for steering a vector and a phase front compensation associated with the transmit and receive signals at the antenna 1005*b*. The calibrator 1060 may receive a transmit signal from the synchronization source 1055 via the antenna 1005 at the first antenna 1005*a*. The calibrator 1065 may provide the calibration based on a time delay adjustment, as described above, and transmit the output signal from the second antenna 1005*b*.

To combine the output signals that the antenna 1005*b* may receive with the other received signals, the synchronization source 1055 may comprise a combiner 1075. For example, the combiner 1075 may be an optical device that passively combines the received signals from the plurality of radiating elements 115(1-m) of the phased array antenna 100 shown in FIG. 1. The combiner 1075 may couple to a linear amplifier 1080. The linear amplifier 1080 may further couple to an analog digital (A/D) converter 1085 to provide a combined signal received form all the radiating elements 115 in the phased array antenna 100.

While the calibrator 1060 may receive a signal at the second antenna 1005*b*, the transmit-receive (TX-RX) isolator 1030 may provide the received signal to the linear amplifier 1035. The calibrator 1060 may use the phase shifter 1025*a* for shifting the phase based on an input from the compensator 1065. A variable gain amplifier (VGA) 1020*a* coupled to the phase shifter 1025*a* may provide a desired amplitude gain for the received signal. To wirelessly couple to the synchronization source 1055, the calibrator 1060 may comprise an optical coupler 1070 that optically couples to the synchronization source 1055. In this way, the calibrator 1060 may calibrate off the curvature of the phase array antenna 100 for the spherical phase of a front and provide a calibrated optical signal 1090 for combining to the combiner 1075 associated with the synchronization source 1065.

By using the phased array antenna 100, a wireless communication system may support a service area across a plurality of geographically distributed communication areas according to one embodiment of the present invention. The service area of the wireless communication system may be partitioned into connected service domains known as cells, where radio device users communicate via radio frequency links over a wireless medium. The wireless medium may be capable of handling cellular signals with cellular modems. For example, the wireless medium may operate according to Code Division Multiple Access (CDMA) standard or Global System for Mobile Communications (GSM) standard, which is a land mobile pan-European digital cellular radio communications system. The wireless communication system may be capable of transmitting and/or receiving voice and data signals on a wireline local area network (LAN) and/or a wireless local area network (WLAN). For example, a cellular wireless network may provide voice, data, or a host of voice and data services in different-generation of wireless networks including digital cellular networks based on standards including UMTS and 3G-1X (CDMA 2000), as well as IS-95 CDMA, GSM, and TDMA.

In one embodiment, a digital cellular network according to one embodiment of the present invention may comprise a plurality of cells communicating over one or more antennas, such as the phased array antenna 100 with a mobile device. The mobile device may be a wireless device, such as a cell phone that may be used whenever a network coverage is provided. However, the mobile device may be any kind of device capable of communicating with the plurality of cells in any one of suitable forms of wireless communication for portable cellular and digital phones in addition to hand-held and hands-free phones.

In one embodiment, using the phased array antenna 100, a wireless communication system may wirelessly communicate mobile data at a speed and coverage desired by individual users or enterprises. According to one embodiment, the high-speed wireless data network may comprise one or more data networks, such as Internet Protocol (IP) network comprising the Internet and a public telephone system (PSTN). The 3rd generation (3G) mobile communication system, namely Universal Mobile Telecommunication System (UMTS) supports multimedia services according to 3rd Generation Partnership Project (3GPP2) specifications. The UMTS also referred as Wideband Code Division Multiple Access (WCDMA) includes Core Networks (CN) that are packet switched networks, e.g., IP-based networks. Because of the merging of Internet and mobile applications, the UMTS users can access both telecommunications and Internet resources. To provide an end-to-end service to users, a UMTS network may deploy a UMTS bearer service layered architecture specified by Third Generation Project Partnership (3GPP2) standard. The provision of the end-to-end service is conveyed over several networks and realized by the interaction of the protocol layers.

Portions of the present invention and corresponding detailed description are presented in terms of software, or algorithms and symbolic representations of operations on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Note also that the software implemented aspects of the invention are typically encoded on some form of program storage medium or implemented over some type of transmission medium. The program storage medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The invention is not limited by these aspects of any given implementation.

The present invention set forth above is described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

While the invention has been illustrated herein as being useful in a telecommunications network environment, it also has application in other connected environments. For example, two or more of the devices described above may be coupled together via device-to-device connections, such as by hard cabling, radio frequency signals (e.g., 802.11(a), 802.11(b), 802.11(g), Bluetooth, or the like), infrared coupling, telephone lines and modems, or the like. The present invention may have application in any environment where two or more users are interconnected and capable of communicating with one another.

Those skilled in the art will appreciate that the various system layers, routines, or modules illustrated in the various embodiments herein may be executable control units. The control units may include a microprocessor, a microcontroller, a digital signal processor, a processor card (including one or more microprocessors or controllers), or other control or computing devices as well as executable instructions contained within one or more storage devices. The storage devices may include one or more machine-readable storage media for storing data and instructions. The storage media may include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy, removable disks; other magnetic media including tape; and optical media such as compact disks (CDs) or digital video disks (DVDs). Instructions that make up the various software layers, routines, or modules in the various systems may be stored in respective storage devices. The instructions, when executed by a respective control unit, causes the corresponding system to perform programmed acts.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. A method for forming an antenna beam from an array antenna having a rear facing side, an aperture, and including a first and a second radiating element, the method comprising:

injecting a synchronization signal wirelessly from a common source at said rear facing side of said array antenna to provide an initial calibration of said array antenna that synchronizes phase of an output signal from said first and second radiating elements to said common source; and in response to a spatial displacement of said first radiating element after said initial calibration of said antenna array, compensating a change in phase of said synchronization signal at said first radiating element based on said spatial displacement to synchronize phase of a first portion of said output signal from said first radiating element to said phase of said synchronization signal at said second radiating element.

2. A method, as set forth in claim 1, further comprising:

injecting said synchronization signal at said first and second radiating elements from said rear facing side of said array antenna; and locking said wireless synchronization the phase of said output signal from each of said first and second radiating elements to phase of said signal from said common source regardless of a spatial location thereof on said aperture of said array antenna.

3. A method, as set forth in claim 2, further comprising:

in response to injecting said synchronization signal into said aperture of said array antenna, providing a synchronized phase-locked output wave to focus said antenna beam.

4. A method, as set forth in claim 1, further comprising:

causing said common source to provide a flat curvature of phase of said synchronization signal.

5. A method, as set forth in claim 1, further comprising:

generating a wave front in which said output signal from each of said first and second radiating elements is in phase.

6. A method, as set forth in claim 1, further comprising:

injecting a low power signal at said rear facing side of said array antenna; and locking phase of said output signal to said low power signal before amplifying in a direction of wave propagation at each of said first and second radiating elements.

7. A method, as set forth in claim 1, further comprising:

flattening, at said first and second radiating elements, a curvature of a phase front associated with said synchronization signal from said common source.

8. A method, as set forth in claim 7, further comprising:

delaying the phase of said synchronization signal at said first and second radiating elements to calibrate the phase of said synchronization signal based on the curvature of said phase front for compensating the curvature of the phase front.

9. A method, as set forth in claim 8, further comprising:

applying a local oscillator signal at said common source to compensate for a phase difference in a received signal at said first and second radiating elements;

detecting whether frequency of said local oscillator signal and said received signal is different by a predetermined frequency value; and if so, applying a phase signal having a frequency equal to the predetermined frequency value.

10. A method, as set forth in claim 1, further comprising:

adding a time delay to each of said first and second radiating elements if an amplified wireless synchronization phase locked to a wave front arriving from a point transmitter at said common source is not in phase.

11. A method, as set forth in claim 10, further comprising:

distributing a timing signal on an optical carrier to provide said time delay.

12. A method, as set forth in claim 10, further comprising:

distributing a timing signal on a radio frequency carrier to provide said time delay.

13. A method, as set forth in claim 10, further comprising:

providing a free space optical synchronization and analog combining of a plurality of signals detected at a hierarchical calibration layer.

14. A method, as set forth in claim 10, further comprising:

adjusting a time delay of each of said first and second radiating elements to match a pulse on a round trip between a detector at each of said first and second radiating elements and said common source.

15. A method, as set forth in claim 14, further comprising:

using a set of predetermined distances between said common source and a corresponding radiating element to recalibrate the time delays such that said first and second radiating elements appear flat on said wave front.

16. An apparatus, comprising:

a phased antenna array that includes:

an antenna array of a first and a second radiating elements; and a synchronizer wirelessly coupled to said antenna array to inject a synchronization signal wirelessly at said first and second radiating elements to provide an initial calibration of said array antenna that synchronizes phase of an output signal from said first and second radiating elements, said first radiating element to compensate a change in phase of said synchronization signal at said first radiating element based on a spatial displacement to synchronize phase of a first portion of said output signal from said first radiating element to said phase of said synchronization signal at said second radiating element in response to said spatial displacement of said first radiating element after said initial calibration of said antenna array.

17. An apparatus, as set forth in claim 16, wherein said antenna array having a rear facing side and an aperture to receive a synchronization signal at said first and second radiating elements to synchronize phase of signals received or transmitted to or from said antenna array of said first and second radiating elements.

18. An apparatus, as set forth in claim 16, wherein said synchronizer further comprises:

a common source to inject said synchronization signal at said first and second radiating elements from said rear facing said of said array antenna to lock phase of a portion of said output signal from each of said first and second radiating elements to phase of said common source.

19. An apparatus, as set forth in claim 18, wherein each of said first and second radiating elements comprises:

a phase shift unit to shift phase of said synchronization signal for causing said each of said first and second radiating elements to operate at a same frequency.

20. An apparatus, as set forth in claim 18, wherein each of said first and second radiating elements comprises:

a timing unit to delay said synchronization signal for causing said each of said first and second radiating elements to operate at a same frequency.

* * * * *